US006601564B2

(12) United States Patent
Davey

(10) Patent No.: US 6,601,564 B2
(45) Date of Patent: Aug. 5, 2003

(54) FLEXIBLE FUEL RAIL

(75) Inventor: Mark John Davey, N. Aurora, IL (US)

(73) Assignee: Senior Investments AG (CH)

( * ) Notice: Subject to any disclaimer, the term of this patent is extended or adjusted under 35 U.S.C. 154(b) by 0 days.

(21) Appl. No.: 09/963,726

(22) Filed: Sep. 26, 2001

(65) Prior Publication Data

US 2003/0056759 A1 Mar. 27, 2003

(51) Int. Cl.[7] ..... F02M 1/00

(52) U.S. Cl. ..... 123/456; 123/468; 123/467; 138/26

(58) Field of Search ..... 123/456, 468, 123/469, 467; 138/26–30

(56) References Cited

U.S. PATENT DOCUMENTS

| | | | | |
|---|---|---|---|---|
| 4,457,280 A | | 7/1984 | Hudson, Jr. | 123/470 |
| 4,510,909 A | | 4/1985 | Elphick et al. | 123/470 |
| 4,519,368 A | | 5/1985 | Hudson, Jr. | 123/468 |
| 4,570,600 A | | 2/1986 | Atkins et al. | 123/468 |
| 4,660,524 A | * | 4/1987 | Bertsch et al. | 123/468 |
| 4,729,360 A | * | 3/1988 | Fehrenbach | 123/467 |
| 4,751,904 A | | 6/1988 | Hudson, Jr. | 123/470 |
| 4,899,712 A | | 2/1990 | De Bruyn et al. | 123/468 |
| 4,971,014 A | | 11/1990 | Usui | 123/470 |
| 4,996,961 A | | 3/1991 | Usui | 123/456 |
| 5,002,030 A | | 3/1991 | Mahnke | 123/469 |
| 5,018,499 A | | 5/1991 | Usui | 123/456 |
| 5,022,372 A | | 6/1991 | Imura et al. | 123/469 |
| 5,024,198 A | | 6/1991 | Usui | 123/468 |
| 5,056,489 A | | 10/1991 | Lorraine | 123/468 |
| 5,072,710 A | | 12/1991 | Washizu | 123/470 |
| 5,080,069 A | | 1/1992 | Hudson, Jr. | 123/456 |
| 5,090,385 A | | 2/1992 | Usui et al. | 123/468 |
| 5,092,300 A | | 3/1992 | Imoehl et al. | 123/469 |
| 5,095,876 A | | 3/1992 | Yonekawa et al. | 123/468 |
| 5,120,084 A | | 6/1992 | Hashimoto | 285/156 |
| 5,169,182 A | | 12/1992 | Hashimoto | 285/332.2 |
| 5,172,939 A | | 12/1992 | Hashimoto | 285/24 |
| 5,197,436 A | | 3/1993 | Ozawa | 123/456 |
| 5,273,015 A | | 12/1993 | Yonekawa et al. | 123/456 |
| 5,357,931 A | | 10/1994 | Semence | 123/456 |
| 5,373,824 A | | 12/1994 | Peters et al. | 123/527 |
| 5,390,638 A | | 2/1995 | Hornby et al. | 123/456 |
| 5,408,971 A | | 4/1995 | Jaeger et al. | 123/456 |
| 5,445,130 A | | 8/1995 | Brümmer et al. | 123/456 |
| 5,447,139 A | | 9/1995 | Yonekawa et al. | 123/456 |
| 5,511,527 A | | 4/1996 | Lorraine et al. | 123/456 |
| 5,575,262 A | | 11/1996 | Rohde | 123/467 |
| 5,577,478 A | | 11/1996 | Tuckey | 123/456 |
| 5,598,824 A | | 2/1997 | Treusch et al. | 123/470 |
| 5,611,313 A | | 3/1997 | Ashcraft | 123/456 |

(List continued on next page.)

FOREIGN PATENT DOCUMENTS

| | | | |
|---|---|---|---|
| JP | 2-104921 | 4/1990 | 75/22 |
| JP | 6-66221 | 3/1994 | 55/2 |

*Primary Examiner*—Thomas N. Moulis
(74) *Attorney, Agent, or Firm*—Greenberg Traurig, P.C.

(57) ABSTRACT

A flexible fuel rail system for fuel injection systems for internal combustion piston engines, particularly for engines having at least one or more banks of aligned cylinders. The fuel rail system incorporates two or more longitudinal fuel rails, connected by one or more crossover sections. The crossover section(s) include(s) one or more sections of enhanced flexibility, preferably corrugations. The fuel rails, crossover sections and sections of enhanced flexibility are preferably all fabricated from metal, preferably monolithically formed from a single piece of metal. The fuel rails preferably are provided with non-circular cross-sectional configurations, so that the walls of the fuel rails will flex, under the influence of fuel pressure pulsations caused by the fuel injectors, so as to substantially reduce or eliminate the negative impacts of such pulsations on the operation of the other injectors in the fuel injection system.

12 Claims, 6 Drawing Sheets

U.S. PATENT DOCUMENTS 5,617,827 A 4/1997 Eschleman et al. ..... 123/456
5,667,255 A 9/1997 Kato ..... 285/133.4
5,713,323 A 2/1998 Walsh et al. ..... 123/184.42
5,718,206 A 2/1998 Sawada et al. ..... 123/470
5,735,247 A 4/1998 Tsuzuki et al. ..... 123/470
5,845,621 A 12/1998 Robinson et al. ..... 123/456
5,852,997 A 12/1998 Vanderpoel ..... 123/446
5,887,910 A 3/1999 Usui ..... 285/288.1
5,896,843 A 4/1999 Lorraine ..... 123/467
5,943,994 A 8/1999 Hosoi et al. ..... 123/468
5,954,031 A 9/1999 Ogiso et al. ..... 123/447
6,009,855 A 1/2000 Espey ..... 123/456
6,073,612 A 6/2000 Ohkubo et al. ..... 123/456
6,082,333 A 7/2000 Vattelana et al. ..... 123/456
6,167,699 B1 1/2001 Johnston et al. ..... 60/304
6,189,510 B1 * 2/2001 Jaeger et al. ..... 123/468
6,205,979 B1 3/2001 Sims, Jr. et al. ..... 123/456
6,213,096 B1 4/2001 Kato et al. ..... 123/456
6,213,243 B1 4/2001 Studebaker et al. ..... 180/314
6,227,170 B1 5/2001 Koshiba ..... 123/456
6,253,739 B1 7/2001 Golomb et al. ..... 123/509
6,314,942 B1 * 11/2001 Kilgore ..... 123/467
6,371,083 B1 * 4/2002 Rossi et al. ..... 123/456
6,401,691 B1 * 6/2002 Kawano et al. ..... 123/456

* cited by examiner

FLEXIBLE FUEL RAIL

BACKGROUND OF THE INVENTION

1. Field of the Invention

The present invention relates to fuel rails for fuel-injected internal combustion piston engines, and in particular, to fuel rails for engines having at least one or more banks of cylinders.

2. The Prior Art

Internal combustion piston engines that are fuel-injected typically employ a common pipeline, into which fuel is supplied from the fuel tank, via one or more fuel pumps, and from which fuel is distributed simultaneously to a plurality of fuel injectors for a bank of cylinders. This common pipeline is typically referred to as a common rail or fuel rail.

Such fuel rails are typically formed from cast metal or extruded metal, or in some specialized, less heat sensitive environments, plastic.

In the environment of a V-engine, two fuel rails are typically employed. In a typical prior art environment, two metal fuel rails are provided, one for each bank. From each rail, fittings extend downwardly, that are metal and/or plastic, extending to the individual fuel injectors. Inasmuch as the fuel is usually supplied from the fuel pump into only one of the fuel rails, one or two crossover pipes are provided, that connect the two rails. Usually, barbed fittings are provided at one or both ends of each rail, onto which a rubber, neoprene, or similar material hose is press-fitted, and possibly clamped. An example of such a system is disclosed in Lorraine et al., U.S. Pat. No. 5,511,527. Because many if not most fuel injection systems presently in use are return-type fuel systems, the excess fuel is pumped back to the fuel tank or to a reserve tank, from an outlet from the other of the two fuel rails.

One potential drawback of such a prior art V-engine fuel rail arrangement, is that wicking can occur at the barbed fittings, between the metal and the flexible elastomer hose ends. The amount of fuel that actually escapes is relatively small, and in the past has not significant consequences. However, in view of ever-tightening regulations on not only exhaust emissions, but also on evaporative fuel emissions, such wicking becomes a source of emissions that must be controlled more closely than in the past. In addition, unless the crossover hoses are coated, provided with impermeable inner or outer layers, or otherwise treated with a permeation barrier, the material itself is somewhat porous to fuel, and will out-gas fuel vapor.

All-metal fuel rails, for both in-line and V-engines, are known. However, such fuel rails typically have had relatively rigid constructions, with relatively high tube wall thickness to diameter ratios (e.g., 1:20), particularly in the bends and joints for the crossover pipes for rails for V-engines. As such, installation becomes problematic, often requiring a considerable amount of "muscling" to force the rail into place. This may lead to imposition of bending forces on welded joints that were not intended to resist or withstand such bending forces, or at particular points along long lengths of pipe, rather than distributing the bending forces along the length of a pipe, which could result in kinking or creasing of a pipe at a particular point, creating a weak spot. Alternatively, highly convoluted crossover pipes must be provided, over the lengths of which, the imposed stresses can be distributed.

One additional phenomenon that occurs in fuel rails is that each fuel injector creates pressure pulsations that rebound throughout the length of the rail. A typical fuel injection system operates in the regime of approximately 30 psi to 60 psi. These pressure pulsations can adversely affect the effective operation of the other fuel injectors, to the point that the metering of fuel from the rails into each cylinder can deviate considerably from design specifications. When the fuel metering deviates from the design specifications, this can adversely impact engine performance, fuel economy, and control over exhaust emissions.

One method that has been employed in the past, to address these undesired cross-effects of the fuel pulsations, is to provide accumulator/compensator devices in combination with the fuel rails. Such compensators, which are generally known in the art, may be affixed to the fuel rail, e.g., at positions between adjacent injectors. Alternatively, such devices may be inserted into the interior of the fuel rails themselves. See, e.g., Rohde, U.S. Pat. No. 5,572,262. However, the provision and installation of such compensator devices can considerably increase the cost and complexity of the fuel rail and the entire fuel injection system.

It would be desirable to provide an improved fuel rail construction for use with in-line and V-configuration internal combustion piston engines, that is less likely to contribute to fuel vapor emissions.

It would also be desirable to provide an improved fuel rail construction that is configured to facilitate its installation.

It would further be desirable to provide an improved fuel rail construction that is less susceptible to adverse cross-effects from fuel pulses created in the fuel rail by the injectors, without having to resort to complex dedicated fuel accumulator/compensator devices.

These and other desirable characteristics of the present invention will become apparent in view of the present specification, including claims, and drawings.

SUMMARY OF THE INVENTION

The invention comprises, in part, a flexible fuel rail system, for delivery of fuel to the fuel injectors of an internal combustion engine, wherein the internal combustion engine has at least two banks of cylinders. The flexible fuel rail system comprises at least two longitudinal fuel rails, each longitudinal fuel rail being operably configured for delivery of fuel to the injectors for the cylinders of one bank of an internal combustion engine having at least two banks of cylinders. At least one crossover section connects the at least two longitudinal fuel rails in fluid communication with one another. At least one region of enhanced flexibility is in the at least one crossover section. The at least two longitudinal rails, the at least one crossover section and the at least one region of enhanced flexibility are all preferably fabricated from metal material.

Preferably, the at least one region of enhanced flexibility comprises at least one corrugation in the metal material. The at least two longitudinal fuel rails, the at least one crossover section and the at least one region of enhanced flexibility are all preferably monolithically formed from a single piece of metal.

The at least two longitudinal fuel rails preferably each have a substantially non-circular cross-sectional configuration. The at least longitudinal rails each preferably have one of the following cross-sectional configurations: substantially rectangular, substantially oval.

In a preferred embodiment of the invention, at least portions of the sidewalls of the longitudinal fuel rails are operably configured to flex outwardly, in concert with fluctuations in the fuel pressure, in order to provide increased cross-sectional area to at least portions of the longitudinal fuel rails, toward reducing the effects of fuel pressure pulsations created by fuel injectors, upon other ones of fuel injectors in a combustion engine having a fuel injection system.

The present invention also comprises in part a flexible fuel rail system, for delivery of fuel to the fuel injectors of an internal combustion engine, wherein the internal combustion engine has at least one bank of cylinders. The flexible fuel rail system comprises at least one longitudinal fuel rail, each longitudinal fuel rail being operably configured for delivery of fuel to the cylinders of one bank of an internal combustion engine having at least one bank of cylinders. Portions of the sidewalls of the at least one longitudinal fuel rail are operably configured to deform in concert with fluctuations in the fuel pressure, in order to provide variable cross-sectional area to said portions of the at least one longitudinal fuel rail, toward reducing the effects of fuel pressure pulsations created by fuel injectors, upon other ones of fuel injectors in a combustion engine having a fuel injection system.

The at least one longitudinal fuel rail preferably has a substantially non-circular cross-sectional configuration. The at least one longitudinal rail preferably has one of the following cross-sectional configurations: substantially rectangular, substantially oval.

The invention further preferably comprises at least two longitudinal fuel rails, connected by at least one crossover section, the at least one crossover section having at least one region of enhanced flexibility.

Preferably, the at least one region of enhanced flexibility comprises at least one corrugation in the metal material.

Preferably, the at least two longitudinal fuel rails, the at least one crossover section and the at least one region of enhanced flexibility are all monolithically formed from a single piece of metal.

DETAILED DESCRIPTION OF THE DRAWINGS

Figure 1:
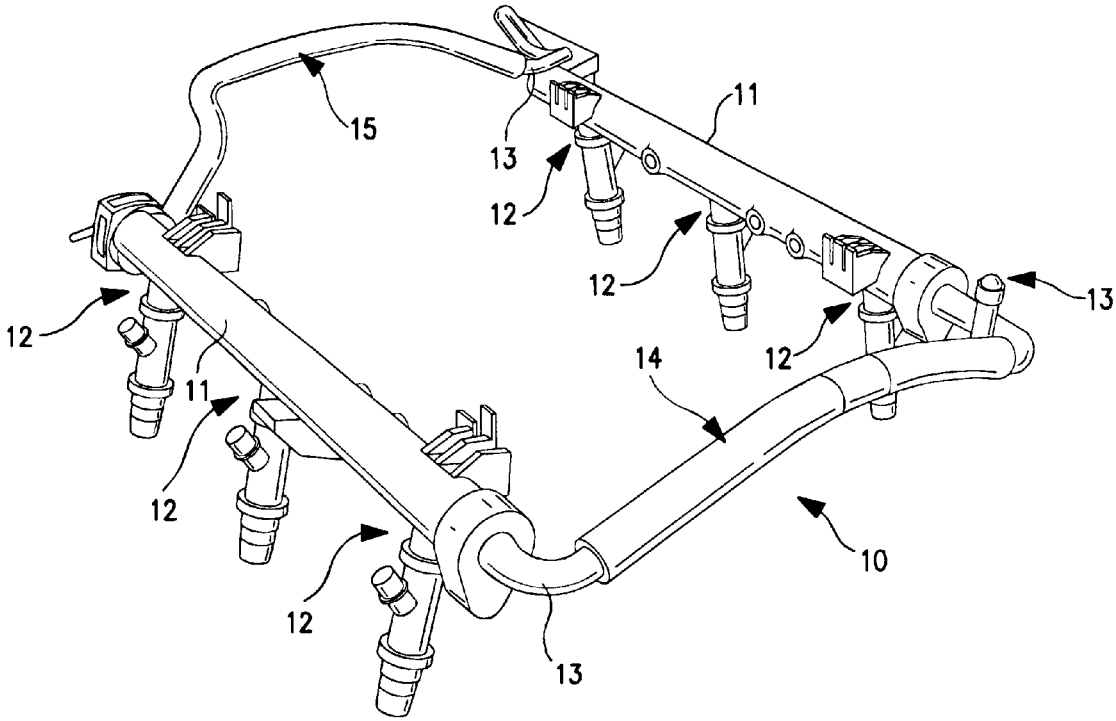
FIG. 1 PRIOR ART
FIG. 1 is a perspective view of a prior art V-configuration internal combustion piston engine fuel rail, having plastic longitudinal rail members, and flexible elastomer crossover tubes.

While this invention is susceptible of embodiment in many different forms, there is shown in the drawings and will be described in detail, a specific embodiment, with the understanding that the present disclosure is to be considered as an exemplification of the principles of the invention and is not intended to limit the invention to the embodiment illustrated.

FIG. 1 is a perspective view of a prior art V-configuration internal combustion piston engine fuel rail, having plastic longitudinal rail members, and flexible elastomer crossover tubes. Fuel rail 10 includes two longitudinal rails 11, with injector connections 12. Crossover connections 13 are provided, typically with barbed ends (not shown), onto which the ends of flexible elastomer hoses 14 and 15 are thrust. As mentioned herein, the use of elastomer hoses, while providing some flexibility to rail 10, upon installation, makes rail 10 susceptible to fuel wicking at the ends of hoses 14 and 15. In addition, hoses 14 and 15, unless provided with permeation barrier layers or coatings or other treatment may exhibit out-gassing of fuel vapors directly through the hose material itself.

Figure 2:
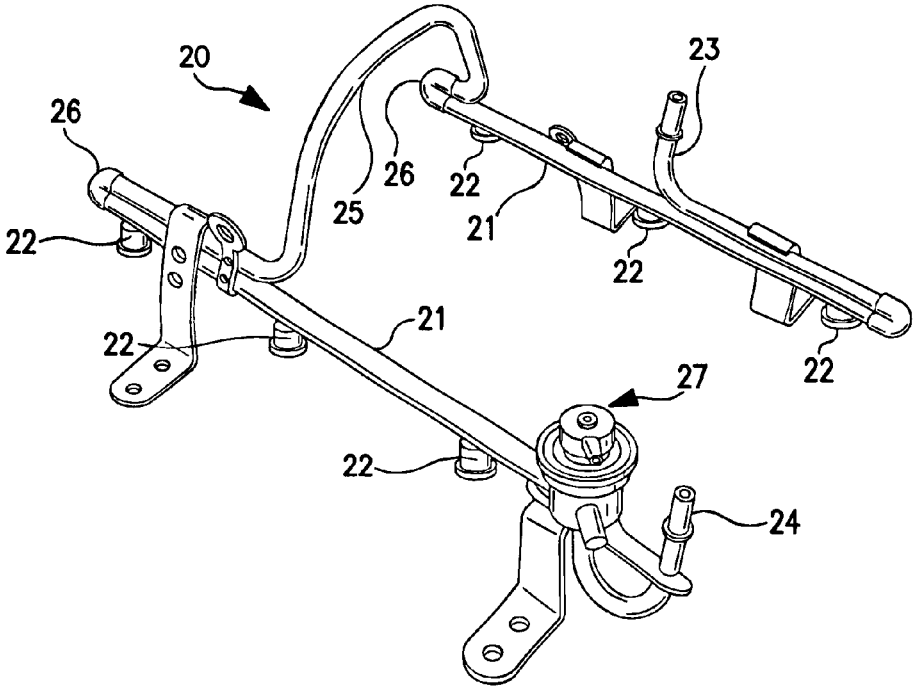
FIG. 2 PRIOR ART
FIG. 2 is a perspective view of a prior art V-configuration internal combustion piston engine fuel rail, having an all-metal, substantially rigid, construction.

FIG. 2 is a perspective view of another prior art V-configuration internal combustion piston engine fuel rail, having an all-metal, substantially rigid, construction. Rail 20 has two longitudinal rails 21, each having three injector connection points 22. Rail 20 has an inlet pipe 23, and a return outlet pipe 24. Crossover pipe 25 is connected, at its ends, to ends of rails 21, by welding or brazing, via U-bends 26. As can be seen, rail 20 is quite robust. In this particular embodiment, attempting to bend or "muscle" the completed rail into place on an engine, in order to make sure that the injector connection points line up with the injectors already installed on an engine, may place undesirable loads on the welds in the U-bends, or alternatively, may create substantial localized bending forces in the crossover pipe 25, e.g., at the very crest of the pipe, where a kink might develop, if the rail structure 20 is subjected to repeated bending forces.

A pressure regulator 27 may be provided at one end of one or both of the fuel rails. Typically, however, such pressure regulators are concern with overall pressure conditions in a rail system, and cannot address the local effects that individual injectors can create in their immediate vicinity.

Figure 3:
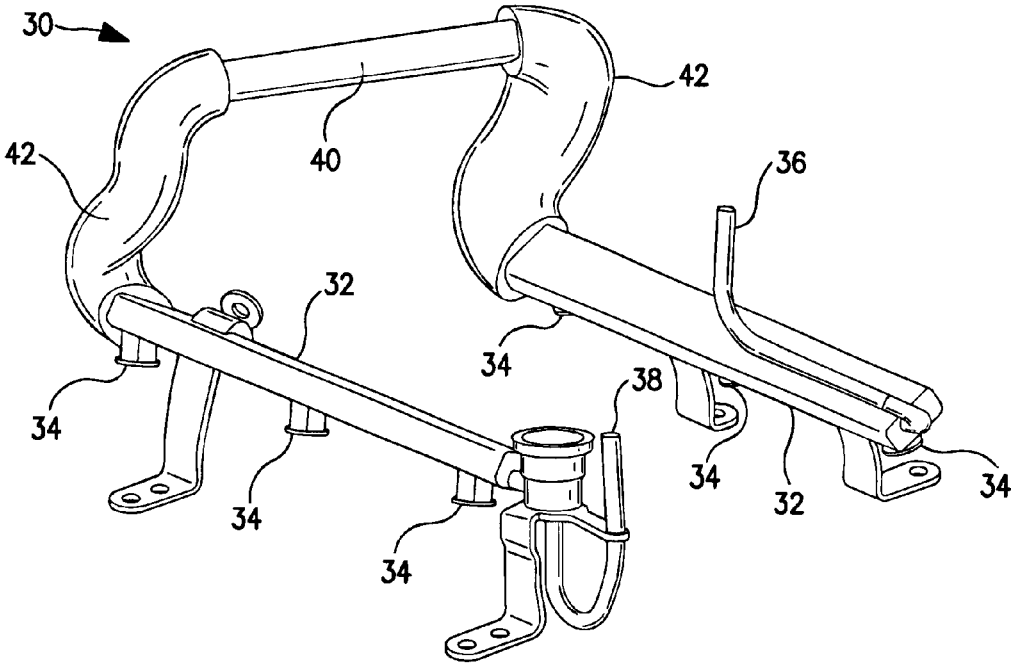
FIG. 3 is a perspective view of a flexible fuel rail construction according to an embodiment of the present invention.

FIG. 3 is a highly schematic perspective view of a flexible fuel rail construction according to an embodiment of the present invention. Flexible rail construction 30 includes two longitudinal rails 32, each having (in this particular application) 3 injector connection points 34, thus indicating that rail construction 30 is for a V-6 engine. Clearly, greater or fewer injector connection points may be required, for a V-4 engine, a V-8 engine, a V-12 engine, etc. Rail construction 30 has an inlet pipe 36 and an outlet return pipe 38. Crossover section 40, in a preferred embodiment of the invention includes two flexible corrugated pipe sections 42 (the corrugations themselves have been omitted from the drawing). In an alternative embodiment of the invention, crossover section 40 with spaced apart corrugated pipe sections 42 may be replaced by a single, continuous longer corrugated section that extends between and joins longitudinal rails 32. This construction is reflected in the broken line portions of FIG. 4, wherein the continuity of the corrugations, throughout and across the crossover section is indicated.

Figure 4:
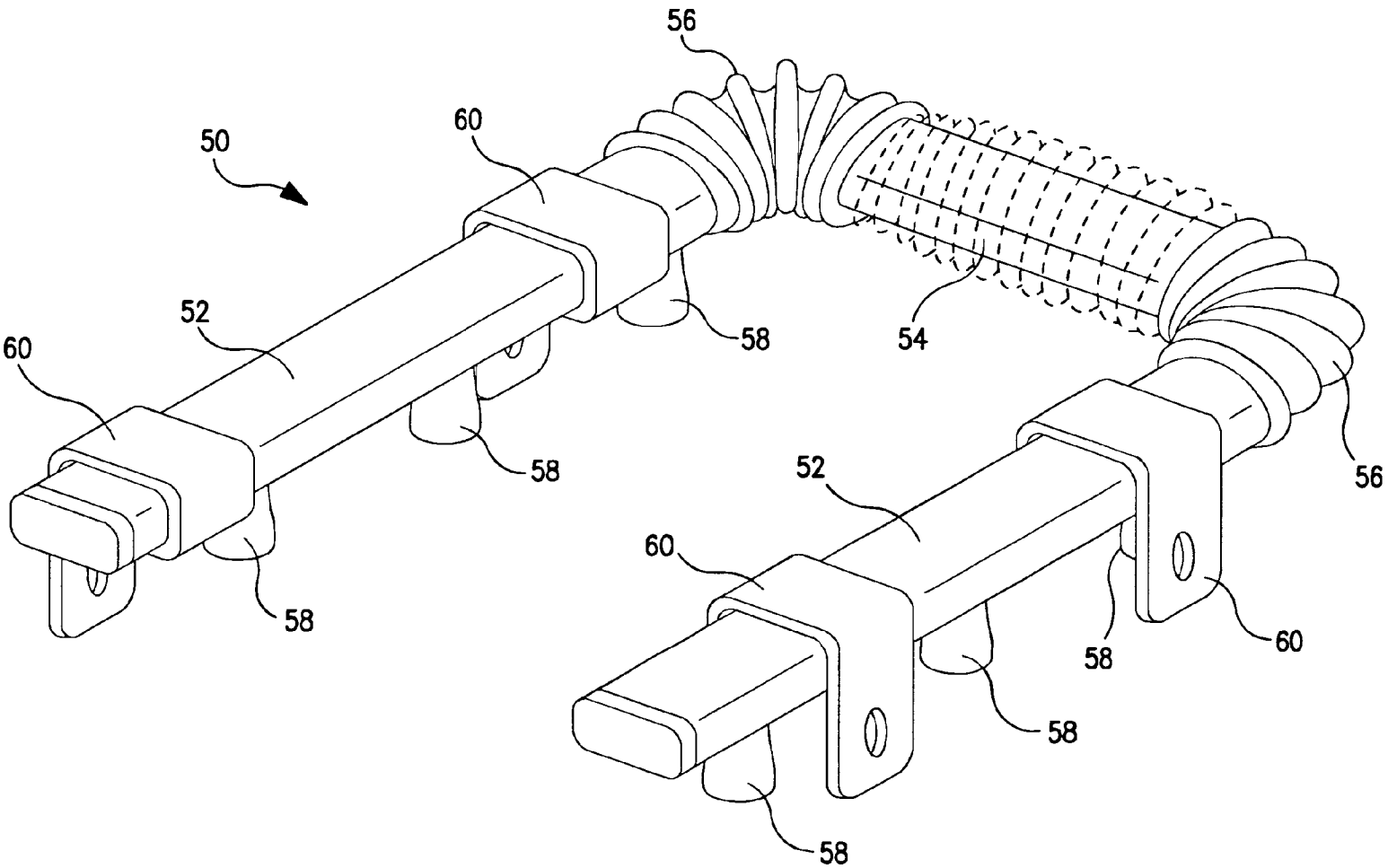
FIG. 4 is a perspective view of a flexible fuel rail construction according to another embodiment of the present invention.
Figure 4A:
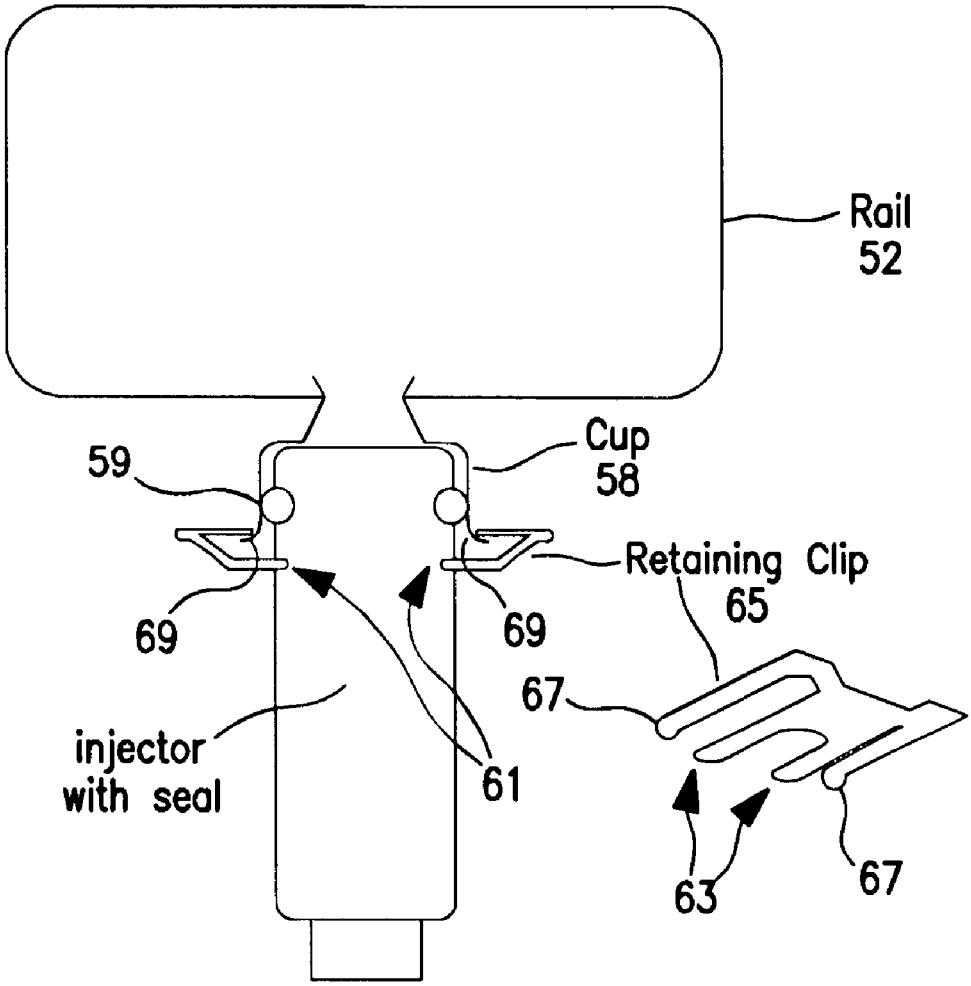

FIG. 4*a* illustrates how, in one embodiment of the invention, an injector 57 may be held in an injector cup 58. The manner of connection is generally conventional. After formation of the rails, the several injector cups are formed, preferably by stamping, then welded or brazed into holes in the bottom of the longitudinal rails. The upper end of each injector 57, which may be of otherwise conventional configuration, will be seated into cup 58, and provided with a sealing connection, e.g., by O-ring 59. Injector 57 will have notches or slots 61, in its sides that will receive prongs 63 of a retaining clip 65. Another pair of prongs 67 will engage a lip 69 on the outside of cup 58. The lower end of each injector will be connected to the engine in any suitable conventional manner. While a particular cup construction and manner of connection to the injectors is shown and described, this construction may be readily modified by one of ordinary skill in the art, having the present disclosure before them.

Rail construction 30 may be fabricated from any suitable material that is resistance to the corrosive effects of fuel, such as a stainless steel. In a preferred embodiment of the invention, rail construction 30 is monolithically formed from a single piece of metal. Alternatively, rail construction 30 may be fabricated from two or more pipe sections that are joined together by any suitable method, such as welding or brazing, etc.

A particular feature of the present invention is that longitudinal rails 32 have non-circular cross-sectional configurations, unlike most prior art and current fuel rail designs. The purpose, to which the non-circular cross-section is put, is to provide resistance to the propagation of fuel pressure pulsations, from one injector to another.

Figure 5:
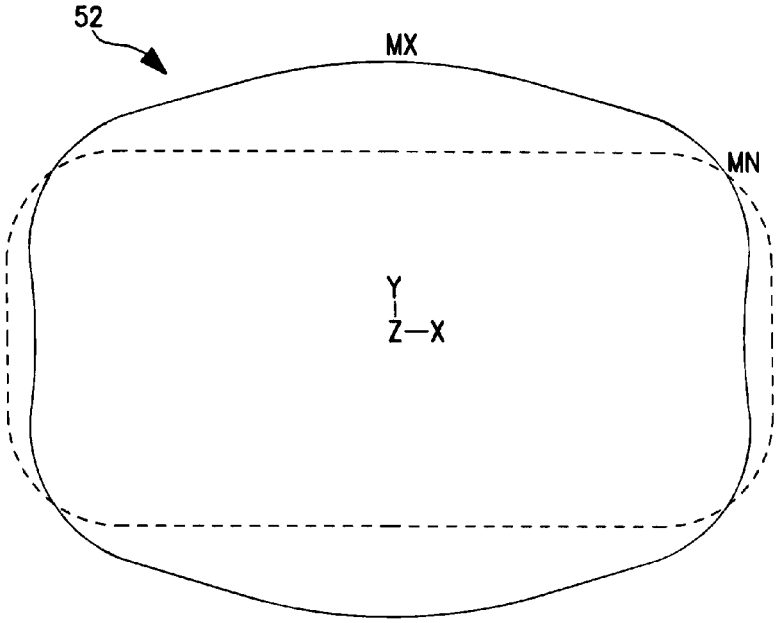
FIG. 5 is a cross-sectional schematic view of a longitudinal fuel rail according to the embodiment of FIG. 4, showing how the cross-section of the fuel rail flexes, during a fuel pressure pulse.
Figure 6:
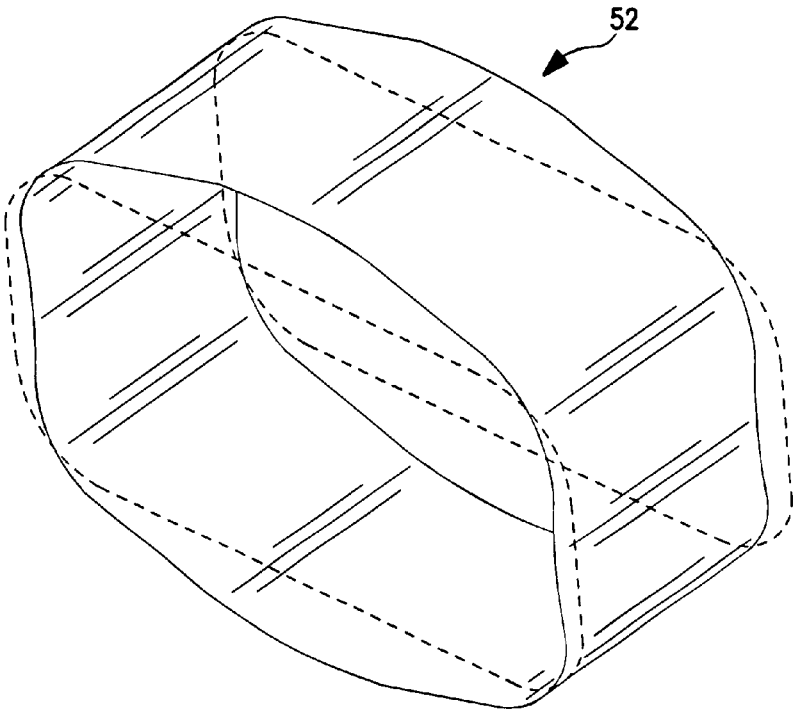
FIG. 6 is a perspective cross-sectional schematic view of a longitudinal fuel rail according to the embodiment of FIG. 4, showing how the cross-section of the fuel rail flexes, during a fuel pressure pulse.

The manner in which the fuel rail construction of the present invention addresses fuel injector pressure pulsations is demonstrated with respect to the embodiment of FIGS. 4–6, in which FIG. 4 is a perspective view of a flexible fuel rail construction according to another embodiment of the present invention. Rail construction 50 includes two rails 52, a single crossover section 54 (although two or more crossover sections may be provided if desired), with two corrugated pipe sections 56. The number and dimensions of the corrugations may vary, according to the specifications and requirements of any particular application. In an alternative embodiment, the corrugated sections may each extend to the center of the crossover, creating, in effect, a single, continuously corrugated section. Six injector connection points (cups) 58 have been shown, but it is to be understood that any number of injector connection points may be provided, as required by the particular application. The inlet and outlet (if a return fuel system) pipe connections have been omitted from the illustration, but are understood to be present in an actual installed embodiment. Brackets 60 are used to attach rail construction 50 to an engine block (not shown).

Figure 7:
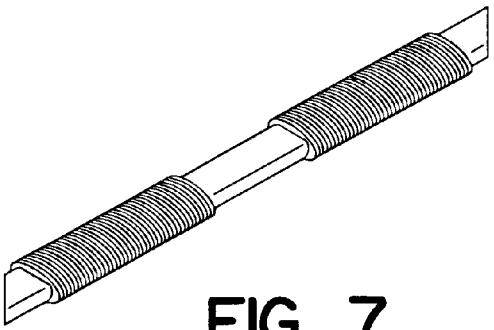
FIG. 7 is a perspective view of a fuel rail section, prior to formation into parallel rails, having a rectangular cross-sectional configuration, and with corrugations that are oval or elliptical in cross-section, wherein the pipe sections are initially monolithically formed from a single piece of metal, and then subsequently bent into a "U" shape, to form the longitudinal rails and crossover pipe section.
Figure 8:
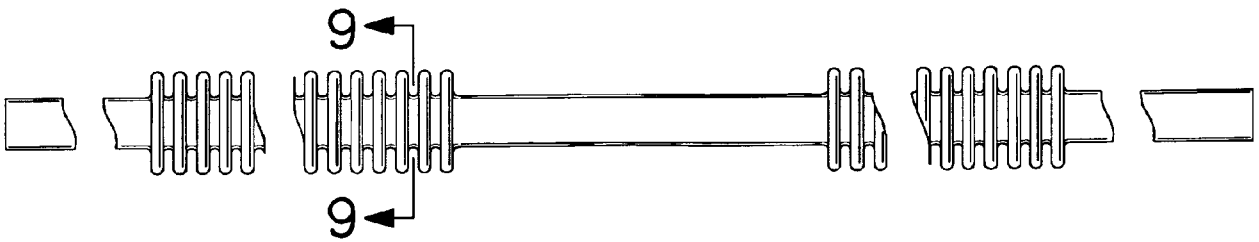
FIG. 8 is a fragmentary side elevation thereof.
Figure 9:
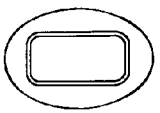
FIG. 9 is a sectional end elevation thereof, taken along line 9—9 of FIG. 8.

Again, the fuel pipe portions of fuel rail construction 50 are preferably monolithically formed from a single piece of metal, although alternatively, several separate components may be formed and joined, using known metal joining techniques. The pipe sections may be initially formed with circular cross-sectional configurations, with (circular or oval) corrugated sections being formed thereafter, and then the straight runs being pressed into their non-circular cross-sectional configurations. The corrugations, while shown having corrs extending outwardly from the nominal diameter of the fuel rail, could alternatively be formed to project inwardly from the nominal rail diameter. Alternatively, the rail sections could be initially formed with non-circular straight run sections and corrugated sections having cross-sectional configurations as desired. As shown in FIGS. 7–9, preferably the length of rail, forming the two rails and at least one crossover section, may be initially formed as a straight pipe section, that is later bent into a "U" shape.

FIG. 5 is a cross-sectional schematic view of longitudinal fuel rail 52 according to the embodiment of FIG. 4, showing how the cross-section of the fuel rail flexes, during a fuel pressure pulse. FIG. 6 is a perspective cross-sectional schematic view of longitudinal fuel rail 52 according to the embodiment of FIG. 4, showing how the cross-section of the fuel rail flexes, during a fuel pressure pulse. In a preferred embodiment of the invention, fuel rail 52 has a generally rectangular cross-sectional configuration, in which the corners have a significant radius. While prior art fuel rail systems, having rectangular cross-sections do exist, they have typically been provided with relatively sharp corners. In a preferred embodiment of the invention, the corner radii would exceed 5 times the material thickness. Current rail designs are usually either fully circular, or have sharp corners of less than 2 times the material thickness. Sharp corners (i.e., extremely small radii, e.g., less than 2 times the material thickness) are not desired, inasmuch as they are costly to obtain, and because the amount of deformation required could cause the metal to enter a regime in which fatigue may become a significant factor. In addition, the working of the metal that is required to provide such sharp corners can introduce localized hardening of the metal which can interfere with the ability of the metal to flex and stretch to provide the pressure fluctuation accommodation. For a fuel rail having a width on the order of magnitude of 1.25 inches (e.g., 0.87 in. to 1.27 in.) and a height on the order of magnitude of 0.625 inches (e.g., 0.43 in. to 0.75 in.), it is anticipated that the corner radii will be on the order of 0.194 inches±0.60 inches.

The aspect ratio can vary widely, although it is known that there is an optimum ratio for functional performance given the minimum amount of material usage for the fuel rail. This aspect ratio is in the 1.5:1 to 2.5:1 range. It is anticipated that for fuel rail constructions for automotive applications, for a fuel rail having a cross-sectional width on the order of one inch, a preferred wall thickness in the range of 0.025–0.035 inches will be used, though, again, greater or lesser thicknesses may be employed depending upon the application.

The corrugations in pipe sections 56 may have round, oval or elliptical cross-sectional configurations and similar interstitial configurations, as may be desired. Alternatively, the raised portions of the corrugations may be oval or elliptical, the pipe sections in the gaps between the raised portions (the "corrs") may retain substantially rectangular cross-sectional configurations, as shown in FIGS. 7–9 herein, wherein the pipe sections of the fuel rail are shown already formed into a tube, but not bent into the "U" shape shown in FIG. 4. Alternatively, the corrs may have substantially rectangular cross-sectional configurations, if desired.

Although not shown, the typical fuel entry point is on the top or the outer side of one of the longitudinal rails. If a return is used, the outlet point is on an opposing longitudinal rail. Both are preferentially located near the termination end s of the longitudinal rails. In a preferred embodiment of the invention, the internal cross-sectional configuration of the longitudinal rails is as shown in the figures, without any internal divider, such as may be used to induce or guide internal counterflow.

FIGS. 5 and 6 show how the cross-section of the fuel rails 52 will flex, as a result of a fuel pressure pulsation. The dotted lines indicate the cross-section of the fuel rail, when no pulsation is taking place (the steady-state position). The solid lines indicate an example of how the cross-section will flex, with the long sides of the cross-section bowing outwardly up and down, and the short sides of the cross-section being drawn toward one another, and even possibly becoming slightly concave, as a result of bending forces being transmitted through the corners from the long sides to the short sides. In actual practice, of course, the cross-sectional configuration will be constantly changing, between the two extreme positions shown in each of FIGS. 5 and 6. In each flexing of the cross-section, the metal is actually stressed (stretches and thins). However, the amount of the stretching may be calculated, using conventional techniques, so that the metal deformation, during each cycle, is well below the permanent deformation limit, so that the components will have a reasonable duty life.

Current fuel rails that purport to offer damping capability are generally square in shape with "sharp" corner radii, as described elsewhere herein. This leads to very high stresses in the corners during flexing from pressure pulsations. Another variant of a rail that offers damping uses two half-shells that are joined together by welding or brazing. the shell design has no beneficial radii in two of its opposing corners, again leading to high stresses in the corners during flexing from pressure pulsations. The fuel rails in the preferred embodiments of the invention have radii in all corners that have a radius to material thickness ratio exceeding 2:1, resulting in lower operating stresses.

It is believed that flexing such as that shown in FIGS. 5 and 6, in the environment of a fuel rail having a non-circular cross-section, in the general area of the parameters described herein, will have a transient net increase in cross-sectional area (and thus in available volume) of approximately 1%–4% or more. This sudden increase in available volume, it is believed, will help to reduce the impact of the pressure pulsations from any given fuel injector, from propagating to adjacent fuel injectors, and thus enhance accuracy of the fuel metering for each fuel injector, with the attendant increase in fuel efficiency, consistency in performance, and control of exhaust emissions.

While the fuel rails in a preferred embodiment of the invention are provided with substantially rectangular cross-sectional configuration, other cross-sectional configurations may be employed, such as an oval, elliptical, trapezoidal or hourglass-shaped cross-sectional configuration (among others), having similar aspect ratios (or "eccentricities") may be employed.

While the cross-sectional flexibility demonstrated in FIGS. 4–6 is shown and described in the environment of a fuel rail system for a V-engine, it is to be understood that the principles also apply to fuel rails for single cylinder bank engines, in which case only a single longitudinal rail would be provided. Alternatively, for an engine having more than two cylinder banks, a corresponding number of longitudinal rails. may be used.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A flexible fuel rail system, for delivery of fuel to the fuel injectors of an internal combustion engine, wherein the internal combustion engine has at least two banks of cylinders, the flexible fuel rail system comprising:

at least two longitudinal fuel rails, each longitudinal fuel rail having an uninterrupted interior volume and being operably configured for delivery of fuel to the injectors for the cylinders of one bank of an internal combustion engine having at least two banks of cylinders, each fuel rail having a closed end and an open end;

at least one crossover section, connecting the open ends of the at least two longitudinal fuel rails in fluid communication with one another;

at least one region of enhanced flexibility, disposed at least in a transition region connecting at least one of the open ends with the at least one crossover section;

the at least two longitudinal rails, the at least one crossover section and the at least one region of enhanced flexibility all being fabricated from metal material.

2. The flexible fuel rail system according to claim 1, wherein the at least one region of enhanced flexibility comprises at least one corrugation in the metal material.

3. The flexible fuel rail system according to claim 1, wherein the at least two longitudinal fuel rails, the at least one crossover section and the at least one region of enhanced flexibility are all monolithically formed from a single piece of metal.

4. The flexibility fuel rail system according to claim 1, wherein the at least two longitudinal fuel rails each have a substantially non-circular cross-sectional configuration.

5. The flexible fuel rail system according to claim 4, wherein the at least longitudinal rails each have one of the following cross-sectional configurations: substantially rectangular, substantially oval.

6. The flexible fuel rail system, according to claim 4, wherein at least portions of the sidewalls of the longitudinal fuel rails are operably configured to flex outwardly, in concert with fluctuations in the fuel pressure, in order to provide increased cross-sectional area to at least portions of the longitudinal fuel rails, toward reducing the effects of fuel pressure pulsations created by fuel injectors, upon other ones of fuel injectors in a combustion engine having a fuel injection system.

7. A flexible fuel rail system, for delivery of fuel to the fuel injectors of an internal combustion engine, wherein the internal combustion engine has at least one bank of cylinders, the flexible fuel rail system comprising:

at least one longitudinal fuel rail, each longitudinal fuel rail being operably configured for delivery of fuel to the cylinders of one bank of an internal combustion engine having at least one bank of cylinders;

portions of the sidewalls of the at least one longitudinal fuel rail being operably configured to deform in concert with fluctuations in the fuel pressure, in order to provide variable cross-sectional area to said portions of the at least one longitudinal fuel rail, toward reducing the effects of fuel pressure pulsations created by fuel injectors, upon other ones of fuel injectors in a combustion engine having a fuel injection system;

the at least one longitudinal fuel rail having a substantially rectangular cross-sectional configuration with two pair of opposed sidewalls, at least three of which sidewalls are configured to deflect in response to fuel pressure pulsations.

8. The flexibility fuel rail system according to claim 7, wherein the at least one longitudinal fuel rail has a substantially non-circular cross-sectional configuration.

9. The flexible fuel rail system according to claim 8, wherein the at least one longitudinal rail has one of the following cross-sectional configurations: substantially rectangular, substantially oval.

10. The flexible fuel rail system according to claim 7, wherein the at least one longitudinal fuel rail comprises at least two longitudinal fuel rails, connected by at least one crossover section, the at least one crossover section further having at least one region of enhanced flexibility.

11. The flexible fuel rail system according to claim 10, wherein the at least one region of enhanced flexibility comprises at least one corrugation in the metal material.

12. The flexible fuel rail system according to claim 10, wherein the at least two longitudinal fuel rails, the at least one crossover section and the at least one region of enhanced flexibility are all monolithically formed from a single piece of metal.

* * * * *